US005239450A

United States Patent [19]

Wall

[11] Patent Number: 5,239,450

[45] Date of Patent: Aug. 24, 1993

[54] ILLUMINATED BUTTON WITH INTERCHANGEABLE IMAGE

[76] Inventor: Stephen F. Wall, 418 Woodland Dr., Hartsville, S.C. 29550

[21] Appl. No.: 676,363

[22] Filed: Mar. 28, 1991

[51] Int. Cl.[5] ..... F21L 15/08

[52] U.S. Cl. ..... 362/104; 362/31; 362/103

[58] Field of Search ..... 362/103, 104, 806, 800, 362/812, 31, 191; 40/550, 541, 570, 580, 581

[56] References Cited

U.S. PATENT DOCUMENTS

| | | | |
|---|---|---|---|
| 2,303,988 | 12/1942 | Christensen | 362/104 |
| 3,804,307 | 4/1974 | Johnston | 362/104 |
| 4,101,955 | 7/1978 | Dunah | 362/104 |
| 4,556,932 | 12/1985 | Lehrer | 362/104 |
| 4,975,809 | 12/1990 | Ku | 362/31 |

*Primary Examiner*—James C. Yeung
*Attorney, Agent, or Firm*—Douglas E. White

[57] ABSTRACT

A round illuminated button pin is back-lit by internal miniature incandescent lamps or LEDs (light emitting diodes). The image is not punctured by the lights — rather, it is printed on a flat disk of transparent or translucent polystyrene (or other suitable plastic). A removable cap of rigid transparent plastic, such as molded acrylic, covers and holds the image. When the cap is removed, the planar circular image disk is loose, except for a pair of positioning notches in its diameter which capture a pair of lugs to keep the image from rotating within the cap. The image disk may quickly be removed simply by turning the button upside down, whereupon it will freely fall out. This allows one button to be reused with any number of interchangeable alternate images.

13 Claims, 2 Drawing Sheets

ILLUMINATED BUTTON WITH INTERCHANGEABLE IMAGE

FIELD OF THE INVENTION

This invention relates to articles for personal adornment, more particularly to a button pin with a removable decorative image which is illuminated by miniaturized lights, such as miniature (also called "sub-miniature") incandescent lamps or light emitting diodes (LEDs).

BACKGROUND OF THE INVENTION

Buttons exist which have LED lamps that flash on and off, or stay on. Many such buttons use LEDs of the type that are of such considerable height that they "puncture" the image and protrude out from the face of the button, thereby illuminating it from the front (in the manner, for example, of a yard light illuminating a lawn). This LED placement obscures a portion of the image. The image on such buttons typically is permanent, i.e. it is glued or otherwise sealed in place. By far the largest market in this field is for round (circular) buttons.

It is desired herein to provide a round novelty button whose image is lighted from behind and whose image is easily replaceable. Such a button may be used over and over to celebrate or advertise different themes or occasions. Thus, for example, a football team could market a single button, together with a plurality of image disks — each disk representing a different team pairing for the season.

Prior developments in this field may be generally illustrated by reference to the following patents:

| Patent No. | Patentee | Issue Date |
|---|---|---|
| 4,556,932 | B. Lehrer et al. | Dec. 03, 1985 |
| 4,912,608 | S. Lee | Mar. 27, 1990 |
| 4,101,955 | R. DuNah | Jul. 18, 1978 |
| 4,531,310 | P. Acson et al. | Jul. 30, 1985 |
| 4,215,388 | R. Reimann | Jul. 29, 1980 |
| 3,927,375 | B. Lanoe et al. | Dec. 16, 1975 |
| 3,407,523 | E. A. Winston | Oct. 29, 1968 |
| 4,774,642 | M. Janko et al. | Sep. 27, 1988 |

U.S. Pat. No. 4,556,932 teaches a square battery-powered lighted novelty pin where a permanent design or figure can be silk-screened onto a transparent portion of the face plate. The face plate itself is removable.

U.S. Pat. No. 4,912,608 teaches an illuminated pin over which is attached a separate locket structure. The locket has an internal image that is interchangeable and is held in place by a transparent cover.

U.S. Pat. No. 4,101,955 teaches the emplacement of snap-on or stick-on exterior decal designs over the lens of a lighted necklace ornament.

U.S. Pat. No. 4,531,310 teaches a battery-powered button pin with interchangeable designs that can be placed over a sound synthesizer.

The rest of the patents are representative of what is in the art.

SUMMARY OF THE INVENTION

The present invention is a round illuminated button pin that is back-lit by internal electric lights, such miniature incandescent lamps or LEDs. The image is not punctured by the lights — rather, it is printed on a flat disk of transparent or translucent polystyrene (or other suitable plastic). Translucent polystyrene blunts hot spots and diffuses the light better than transparent material, and is preferred.

A removable cap of rigid transparent plastic, such as molded acrylic, covers and holds the image. When the cap is removed, the planar circular image disk is loose, except for a pair of positioning notches which capture a pair of lugs to keep the image from rotating within the cap. The image disk may quickly be removed simply by turning the button upside down, whereupon it will fall freely out. This allows one button to be reused with any number of interchangeable alternate images.

Features and Advantages

An object of this invention is to provide a button pin which includes a round casing; a transparent cap removably attached to the front of the casing; a flat round image disk removably sandwiched between the front of the casing and the cap; illumination means in the casing; and a pin mounted on the rear of the casing, whereby the apparatus may be removably attached to an article of clothing.

Another object is to provide a pair of positioning lugs on the front of the casing and a pair of matching notches in the image disk in cooperative engagement with the lugs, whereby the image disk is prevented from rotating within the cap.

A further object is to provide an image disk made of translucent plastic, although transparent plastic may be suitable in some applications.

Yet a further object is to include a rectilinear casing aperture in the front of the casing and a lens in the casing aperture operably connected to the illumination means, the lens having a flat rectilinear front face and a parabolic rear face, the rear face being coated with a reflective material.

Still another object is to provide a conductive mount in the casing, the conductive mount supporting the lens and the illumination means, and to provide electrical contacts for removable batteries, the contacts operably connected by the conductive mount to the illumination means.

Another object is to include a rectilinear mount aperture in the conductive mount through which the front face of the lens passes.

Yet another object or feature is a flat base plate in the rear of the casing, the base plate having a slideably removable battery access lid.

Another feature is circuit board means for flashing the lamps or LEDs at periodic intervals.

Another object is to provide an apparatus which is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," "leftwardly,"

and "rightwardly" will refer to directions in the drawings to which reference is made. The words "inwardly" and "outwardly" will refer to directions toward and away from, respectively, the geometric center of a device and designated parts thereof.

Figure 1:
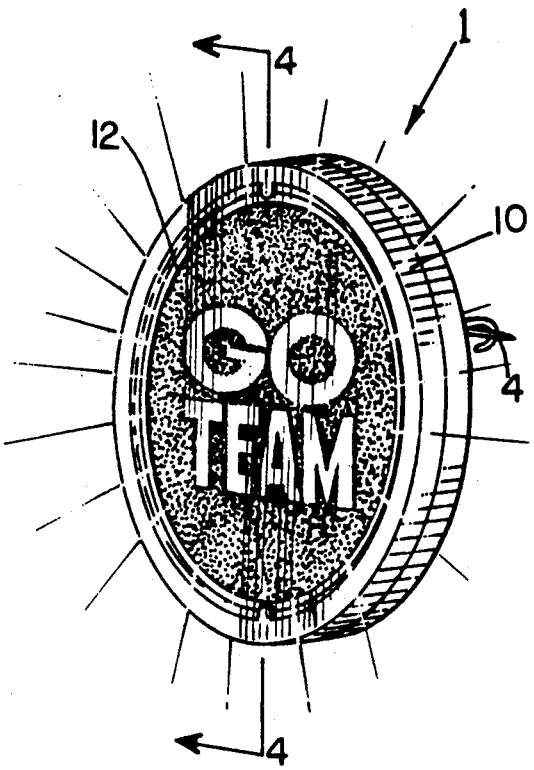
FIG. 1 is a perspective frontal view of a preferred button of this invention.

| Drawing Reference Numerals | |
|---|---|
| 1 | button |
| 4 | safety pin on 6 |
| 6 | base plate |
| 8 | casing |
| 9 | face of 8 |
| 10 | cap over 8 |
| 12 | image |
| 14 | battery lid in 6 |
| 16 | switch |
| 20 | wall of 10 |
| 22 | channel in 8 |
| 26 | image disk |
| 28 | notch in 26 |
| 30 | lug of 8 |
| 32 | aperture in 8 for 44 |
| 34 | well for 36 |
| 36 | battery |
| 38 | contact on 40 for 36 |
| 39 | contact on 14 for 36 |
| 40 | mount, conductive |
| 42 | aperture.in 40 for 44 |
| 44 | lens |
| 45 | reflective coating on 44 |
| 46 | well in 44 for 48 |
| 47 | flange on 44 |
| 48 | electric light |
| 50 | circuit board for 48 |
| 54 | spacing collar on 6 for 56 |
| 56 | screw |
| 58 | lip on 6 for 60 |
| 60 | snap on 14 |

DESCRIPTION OF A PREFERRED EMBODIMENT

Figure 2:
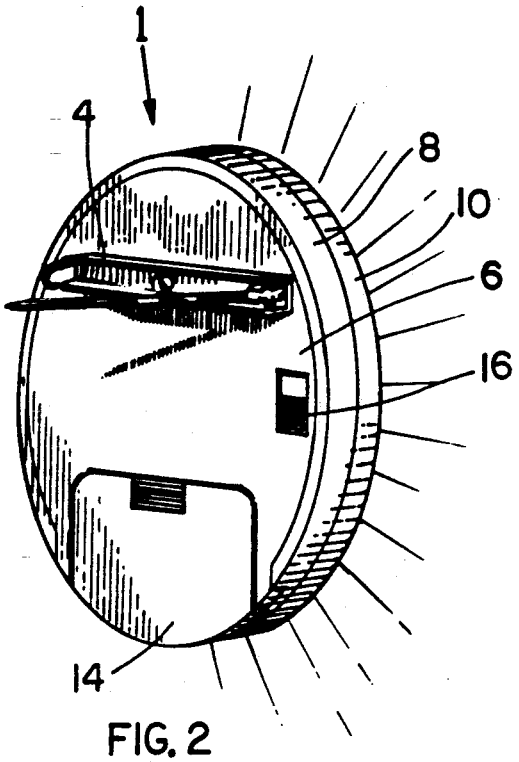
FIG. 2 is a perspective rear view of the button of FIG. 1.

Referring generally to FIGS. 1 and 2, there is illustrated therein an illuminated button 1 of this invention. Button 1 is attached to the shirt, jacket, lapel or other portion of the user's dress by means of a safety pin 4 which is affixed to the rear base plate 6 of the button.

The base plate mates with a housing or casing 8 onto which is mounted a snap-off cap 10. The cap 10 is constructed of rigid transparent plastic so as to clearly display underneath it a printed message or image 12. The base plate 6 houses a removable battery lid 14 and a sliding electrical switch 16.

The cap has a perimeter wall 20 which tapers inward slightly so as to securely grip the casing 8 within a congruent channel or recess 22 that is formed at the forward circumference of the casing. Sandwiched between the cap and the front of the casing is a removable image disk 26 (FIG. 3), which disk preferably is formed of translucent polystyrene so as to effectively diffuse transmitted light. However, other translucent or transparent plastics ma be substituted in the image disk. The base plate 6, casing 8, battery lid 14 and switch 16 may be made of any suitable plastic, preferably one which is opaque.

Figure 4:
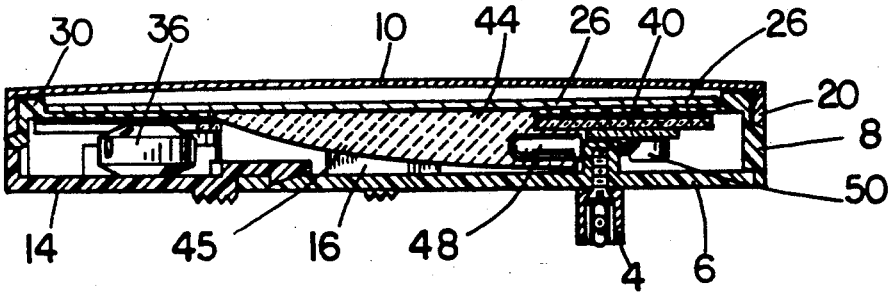
FIG. 4 is a sectional elevation of the button of FIG. 1, taken along line 4—4 of FIG. 1.
Figure 3:
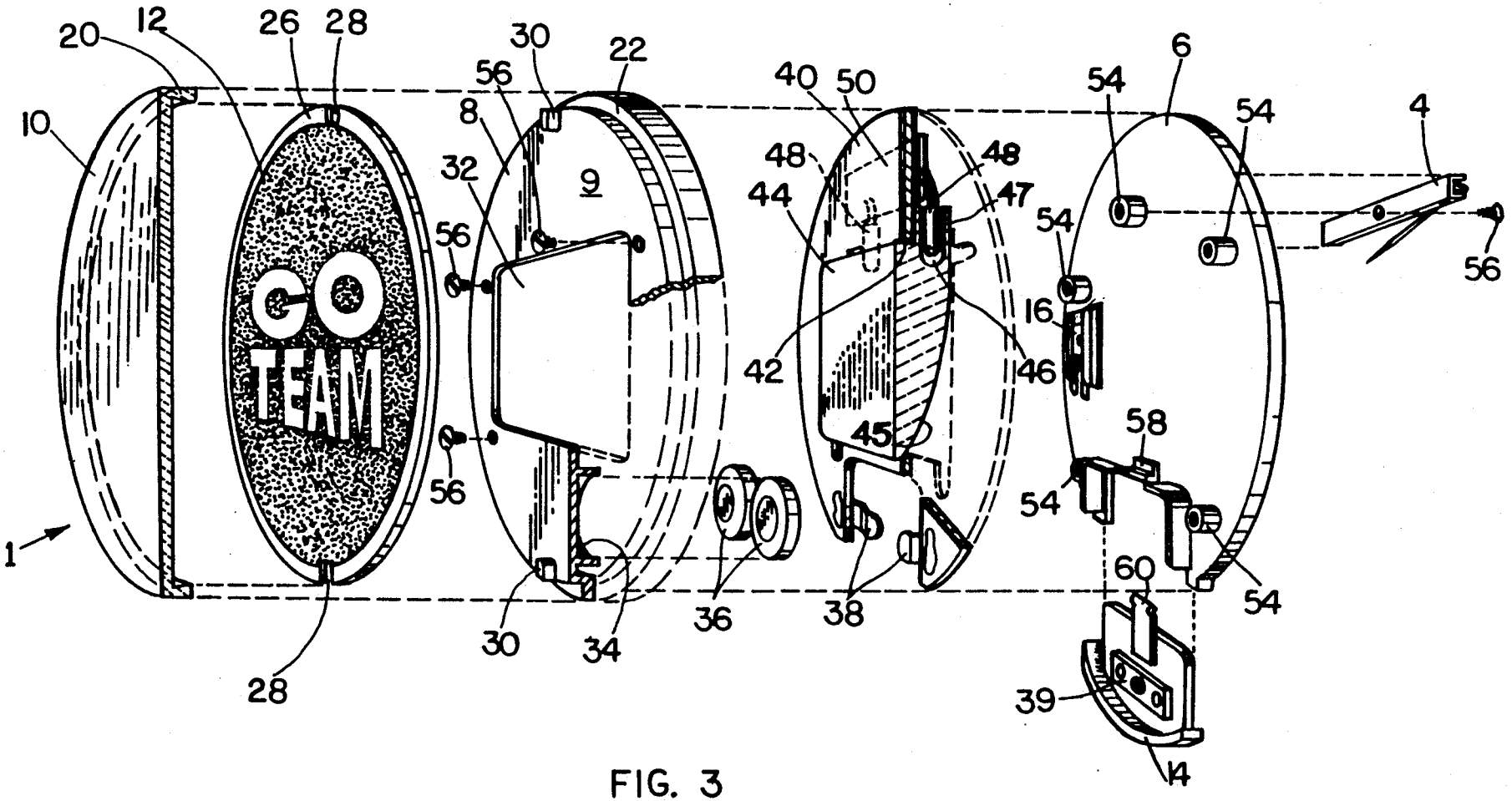
FIG. 3 is an exploded perspective view of the button of FIG. 1.

FIG. 3 shows the button 1 disassembled in an exploded view. FIG. 4 is a view of the same button in cross-section, showing the match-up of interior parts when the button is fully assembled. Insofar as the image disk 26 is preferably round, as well suits the round button motif, and is not glued or otherwise secured to the casing 8, it might be subject to turning out of alignment during use. Therefore, the image disk forms at its circumference an opposed pair of positioning notches 28 that mate with similarly located positioning lugs 30 that project from the front of the face 9 of the casing.

A rectilinear lens aperture 32 is formed in the center of the face of the casing. A pair of battery wells 34 project rearwardly from behind the casing face 9 and are used to secure replaceable batteries 36 of standard retail design. Electrical contacts 38,39 for the batteries are mounted on a conductive mounting plate 40 and on the battery lid 14, respectively. A second matching lens aperture 42 is formed in the center of the conductive mount 40. Mount 40 supports a curved, preferably parabolic, lens 44, the front output face of which protrudes through apertures 32,42. The curved rear surface of the lens bears a coating 45 which reflects and redirects light out of the front of the lens as the light is transmitted down from the top of the lens. A pair of wells 46 are bored or molded into a flange 47 which projects upwardly from the top of the lens 44, behind the mounting plate 40.

A pair of electric lights 48, preferably miniature (also known as "sub-miniature") incandescent lamps having tungsten filaments, mate with the wells 46 of the lens. More or fewer lights could be incorporated in or around the lens with substantially equivalent effect. The lights are electrically connected by lead wires to a circuit board 50, which circuit board is mounted on the rear of the conductive mount 40 in electrical cooperation with the batteries 36 and the switch 16. Turning the switch to an "on" position causes the circuit board to flash the lights 48 at periodic intervals. Alternatively, the circuit board 50 could be wired to power the lights on continuously while the switch is on. However, the latter option would cause the batteries to wear out substantially sooner. In any event, the design of either type of circuit board is conventional and well-known in the art.

The button apparatus 1 is held together by a series of spacing posts or collars 54 into which screws 56 are secured. A lip 58 on the inner surface of the base plate 6 engages with a snap 60 on the battery lid 14 to securely hold the lid onto the base plate.

While the above provides a full and complete disclosure of the preferred embodiments of this invention, various modifications and equivalents may be employed without departing from the true spirit and scope of the invention. Such changes might involve alternate materials, components, structural arrangements, capacities, sizes, operational features or the like. Therefore, the above description and illustrations should not be construed as limiting the scope of the invention which is defined by the appended claims.

What is claimed is:

1. Button pin apparatus including:

a round casing having a front and a rear;

a transparent cap removably attached to the front of the casing;

a flat round image disk made of translucent plastic removably sandwiched between the front of the casing and the cap;

illumination means in the casing;

a pin mounted on the rear of the casing, whereby the apparatus may be removably attached to an article of clothing;

at least one positioning lug on the front of the casing;

at least one notch in the image disk in cooperative engagement with the at least one lug, whereby the image disk is prevented from rotating within the cap;

a rectilinear casing aperture in the front of the casing;

and a lens in the casing aperture operably connected to the illumination means, the lens having a flat rectilinear front face and a curved rear face, the rear face being coated with a reflective material.

2. The apparatus of claim 1 further including:

a conductive mount in the casing, the conductive mount supporting the lens and the illumination means;

and electrical contacts on the conductive mount for removable batteries, the battery contacts operably connected by the conductive mount to the illumination means.

3. The apparatus of claim 2 further including:

a rectilinear mount aperture in the conductive mount through which the front face of the lens passes.

4. The apparatus of claim 3 further including:

a flat base plate in the rear of the casing, the base plate having a slideably removable battery access lid;

and an outwardly directed electrical switch, the switch operably connecting the battery contacts to the illumination means.

5. The apparatus of claim 4 wherein:

the illumination means includes at least one miniature incandescent lamp; and circuit board means for flashing the at least one miniature incandescent lamp at periodic intervals.

6. The apparatus of claim 5 wherein:

there are two miniature incandescent lamps.

7. Button pin apparatus including:

a round casing having a front and a rear;

a transparent cap removably attached to the front of the casing;

a flat round transparent plastic image disk removably sandwiched between the front of the casing and the cap;

illumination means in the casing;

a pin mounted on the rear of the casing, whereby the apparatus may be removably attached to an article of clothing;

a rectilinear casing aperture in the front of the casing;

a lens in the casing aperture operably connected to the illumination means, the lens having a flat rectilinear front face and a curved rear face, the rear face being coated with a reflective material;

a conductive mount in the casing, the conductive mount supporting the lens and the illumination means;

and electrical contacts on the conductive mount for removable batteries, the battery contacts operably connected by the conductive mount to the illumination means.

8. Button pin apparatus including:

a round casing having a front and a rear;

a transparent cap removably attached to the front of the casing;

a flat round image disk made of translucent plastic removably sandwiched between the front of the casing and the cap;

illumination means in the casing;

means for preventing the image disk from rotating within the cap, the preventing means having a pair of positioning lugs on the front of the casing, and a pair of notches in the image disk in cooperative engagement with the pair of lugs, whereby the image disk is loosely held between the cap and the casing, but is prevented from rotating;

a pin mounted on the rear of the casing, whereby the apparatus may be removably attached to an article of clothing;

a rectilinear casing aperture in the front of the casing;

and a lens in the casing aperture operably connected to the illumination means, the lens having a flat rectilinear front face and a curved rear face, the rear face being coated with a reflective material.

9. The apparatus of claim 8 further including:

a conductive mount in the casing, the conductive mount supporting the lens and the illumination means;

and electrical contacts on the conductive mount for removable batteries, the battery contacts operably connected by the conductive mount to the illumination means.

10. The apparatus of claim 9 further including:

a rectilinear mount aperture in the conductive mount through which the front face of the lens passes.

11. The apparatus of claim 10 further including:

a flat base plate in the rear of the casing, the base plate having a slideably removable battery access lid.

12. Button pin apparatus including:

a round casing having a front and a rear;

a transparent cap removably attached to the front of the casing;

a flat round translucent plastic image disk removably sandwiched between the front of the casing and the cap;

illumination means in the casing, the illumination means having at least one miniature incandescent lamp; and circuit board means for flashing the at least one miniature incandescent lamp at periodic intervals;

a pin mounted on the rear of the casing, whereby the apparatus may be removably attached to an article of clothing;

at least one positioning lug on the front or the casing;

at least one notch in the image disk in cooperative engagement with the at least one lug, whereby the image disk is prevented from rotating within the cap;

a rectilinear casing aperture in the front of the casing;

a lens in the casing aperture operably connected to the illumination means, the lens having a flat rectilinear front face and a parabolic rear face, the rear face being coated with a reflective material;

a conductive mount in the casing, the conductive mount supporting the lens and the illumination means;

a rectilinear mount aperture in the conductive mount through which the front face of the lens passes;

electrical contacts on the conductive mount for removable batteries, the battery contacts operably connected by the conductive mount to the illumination means;

and a flat base plate in the rear of the casing, the base plate having a slideably removable battery access lid.

13. The apparatus of claim 12 wherein:

there are two miniature incandescent lamps and the image disk is polystyrene.

* * * * *